United States Patent [19]

Priaroggia et al.

[11] 4,415,761

[45] Nov. 15, 1983

[54] TAPED ELECTRIC CABLE

[75] Inventors: Paolo G. Priaroggia; Elio Occhini, both of Milan, Italy

[73] Assignee: Societa Cavi Pirelli Societa per Azioni, Milan, Italy

[21] Appl. No.: 283,556

[22] Filed: Jul. 15, 1981

[30] Foreign Application Priority Data

Jun. 6, 1980 [IT] Italy ..... 22595 A/80

[51] Int. Cl.[3] ..... H01B 7/02; H01B 9/06

[52] U.S. Cl. ..... 174/25 R; 174/120 C; 174/120 FP

[58] Field of Search ..... 174/25 R, 25 G, 120 R, 174/120 C, 120 SR, 120 FP, 122 R

[56] References Cited

U.S. PATENT DOCUMENTS

| | | | |
|---|---|---|---|
| 2,275,187 | 3/1942 | Clark | 174/122 R |
| 2,289,734 | 7/1942 | Scott et al. | 174/25 R |
| 2,320,922 | 6/1943 | Ford | 174/25 R |
| 2,607,823 | 8/1952 | Camilli et al. | 174/122 R |
| 2,607,824 | 8/1952 | Camilli et al. | 174/122 R |
| 2,650,261 | 8/1953 | Davey | 174/120 SR |
| 2,827,510 | 3/1958 | Hunsinger | 174/122 R |
| 3,077,510 | 2/1963 | Olds | 174/120 R |
| 3,077,514 | 2/1963 | Kang | 174/120 R |
| 3,078,333 | 2/1963 | Kang | 174/120 R |
| 3,662,092 | 5/1972 | Franco | 174/120 FP |

FOREIGN PATENT DOCUMENTS

| | | | |
|---|---|---|---|
| 1288662 | 2/1969 | Fed. Rep. of Germany | 174/25 R |

OTHER PUBLICATIONS

Jagielski, Otto F.; "Theory and Practice of Modern Taping and Stranding"; Wire, Apr. 1940, pp. 211-213.

*Primary Examiner*—A. T. Grimley
*Assistant Examiner*—Morris H. Nimmo
*Attorney, Agent, or Firm*—Brooks, Haidt, Haffner & Delahunty

[57] ABSTRACT

The invention concerns an improvement in taped cables having large diameter and suitable for use at voltages up to and over 1000 kV. The taping of one or more layers is wound according to a double-start or multi-start helix, said helix having an inclination less than 75°.

4 Claims, 1 Drawing Figure

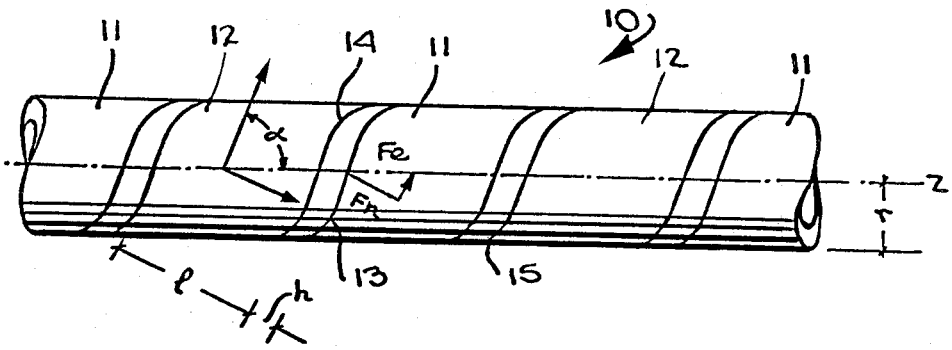
11
12
14
11
10
12
11
α
Fe
Fh
z
r
13
15
ℓ
h

TAPED ELECTRIC CABLE

The present invention relates to an improvement in so-called lapped or taped electric cables, and in particular, relates to taped cables having large diameter (up to and over 100 mm) and suitable for use at high and very high voltages (up to and over 1000 kV).

By the expression "taped cables" applicant is referring to those cables having a conductor which is covered with an insulation constituted by a plurality of layers of helically wound tapes.

For the purposes of the invention, reference is made to taping in which, between one turn or convolution of the tape and the subsequent one, a spacing or interval is provided. The helix of each layer is offset with respect to that of the underlying and/or overlying contiguous layer. This means that the tape of one convolution in a layer corresponds to an interval of the underlying and/or overlying layer.

The taped cables are generally impregnated with a fluid having high dielectric strength e.g., a liquid (more generally known to those skilled in the art as a fluid oil), a compound, or a gas under pressure, equal to, or greater than, atmospheric pressure.

The tapes are constituted by an electrically insulating material e.g., paper, solid synthetic polymers, tapes constituted by two or more layers, such as tapes of paper of different density or thickness, or a combination of paper and a solid synthetic polymer, or the like.

The technicians of the field know that the taped cables can have significant drawbacks, in spite of the expedients used, such as, an interval provided between one convolution and the other to give the cable a good flexibility with minimum damage for the tapes, a narrow width for these latter (<30 mm) and an offset of the convolutions in the contiguous layers.

One of these drawbacks is the collapsing of the tapes owing to bending actions of the cable. A tape can undergo two types of collapsing.

A first type is that occuring at the intervals and apparent in the form of deep folds, which can get cut, or "gap" folds as they are called. These deep folds are the results of a local collapse of the tape, and they damage the tape irreversibly. Therefore, the cable has a reduced dielectric strength with respect to that for which it has been designed.

Alternatively, a second type of collapsing occurs on the surface of the tape and consists in the formation of lozenge shaped wrinkles.

Such phenomena result in a total collapse of the dielectric strength. Also, it must be borne in mind that, generally, in the tapes, the transverse mechanical properties, i.e. in the transverse direction or transverse rigidity modulus of the tape, are less than the longitudinal ones. Further, during the bending of a cable, it is always stressed in such a way that the greater component of the stress acts transversly to the tape, that is, in the direction in which said rigidity modulus is not the best.

Another drawback found in the cables in use up to now is the tendency of the convolutions of the outermost layers to slide or slip during bending. The greater the diameter of the cable is, the more frequent and evident said drawback is.

Slipping of the convolutions of the outermost layer, tends to concentrate in the same transverse section and results in taping empty spaces.

This "empty-spaces" phenomenon of the tapes, that is known in the art as the formation of "soft-spots" caused by bending, affects the efficiency of the dielectric, because it contributes to making the dielectric non-uniform in distribution along the cable.

It has been noted that in some cables having the same diameter and making use of wide tapes (>30 mm and up to and over 45 mm), the behavior of said wide tapes in consequence of bending is better than the behavior of cables wound with conventional tapes of narrow width (<30 mm).

In particular, the damages due to "soft-spots" are reduced.

The improvement is due to the greater slope or inclination (a smaller angle between the edge of the tape and the longitudinal axis of the cable) of the winding helix of the taping. The slope is determined by the width of the tape.

This greater slope or inclination permits better utilization of the tape in the sense in which its mechanical properties are better and permits a reduction of the component of the axial stress perpendicular to the "gaps".

The present invention aims at providing a cable having taping which is such as to eliminate as completely as possible, the drawbacks of the cables in use up to now.

The cable according to the invention is such as to permit, in each case, a choice of the inclination of the tapes with respect to the longitudinal axis of the cable, to obtain optimum bending conditions for each layer.

The taped cable according to the invention permits also exploitation of the advantages of lower friction between contiguous layers, typical of the tapes having a narrow width.

More precisely the object of the invention is a taped cable, in which between each convolution and the next following one of the taping of one layer, helically wound around the conductor, an interval or gap is provided, this latter interval being offset with respect to the interval between two corresponding convolutions of the overlying and/or underlying contiguous layer, characterized by the fact that the helix according to which the tape of at least one layer is wound, is a multi-start helix.

In a preferred embodiment provides that said helix has a double-start formation.

According to a further preferred embodiment, the inclination of said helix with respect to the axis of the cable is less than 75°.

Preferably, said inclination is 70°.

Another preferred embodiment consists in using tapes having a width between about 20 and 30 mm.

The single FIGURE of the enclosed sheet of drawing shows, by in side elevation and way of non limiting example, a practical realization of the taping of the invention.

The taped cable 10 represented in the figure, has the tapes of all the layers, or of at least part of the layers and, in particular, the outermost layer or layers (this latter having a radius of r=25 mm) wound according to a double-start helix 11 and 12. The tape 11 of one start, for example, has a width 1=22 mm and is spaced from tape 12 of the second start having equal width, by an interval 15 of width h=1 mm.

The double-start helix of the figure has an inclination $\alpha=73°$. $\alpha$ is assimilated to the angle formed by the edge 13 or 14, respectively, of the tape 11 or 12, with the longitudinal axis z of the cable.

It has been found that better results are obtained with $\alpha < 75°$.

Also, it has been found that optimum results are, in general, obtained with an inclination of the helix of about 70°.

In this case, the longitudinal stress $F_e$ which acts on the cable in bending conditions gives a component $F_n$ perpendicular to the inclination of the edge 13, or to the interval 15, lower than that which would be obtained with an angle $\alpha > 75°$, as in the state of the art, when tapes of narrow width are used. As a result, a significant reduction of the risk of the "gap" folds is obtained. This reduction is more substantial if it is considered that by using a multi-start helix, it is possible to choose the number of the starts permitting, with the same diameter of the layer, the use of a tape able to provide a helix of such an inclination as to produce the optimum results.

Also, better results are achieved when the width of the tapes 11 and 12 is maintained, as in the exemplified case, within narrow sizes and in general, between about 20 and 30 mm.

This expedient, together with a greater inclination of the helix, has shown that one can also reduce greatly the risk of "soft-spots".

It is possible that one of the elements contributing to the improvement, but not the only one which contributes to reduction of the "soft-spots" risk is the fact that by reducing the entity of the component $F_n$ acting on the tape, said component is absorbed by the tape itself. The tape can deform elastically, reducing the tendency of widening of the intervals or "gaps" between one convolution and the other.

Consequently, it should be realized that a geometrical structure which, having the intervals between the tapes appropriately inclined with respect to the planes perpendicular to the axis of the cable, does not create preferred sliding zones in said planes.

Another element which contributes to the elimination of "soft-spots" is also the narrow width that it is possible to assign to the tapes by selecting the most suitable multistart helix, depending on the desired result. A smaller width permits a lower friction between contiguous layers and consequently, permits the return of the tapes, which have undergone a relative sliding because of bending, to their original positions when the cable is straightened.

By means of the invention, a taped cable is obtained in which, the insulation cannot be damaged as a result of bending of the cable and, in particular, the cable does not undergo local modifications of the distribution of the electric field.

Of course, it is not necessary that the tapings of all the layers of a taped cable must be arranged as taught by the invention. Sometimes, it will be sufficient to tape, according to the invention, only one part of the layers or only one layer.

Preferably, the layers, the outermost layer or the layer having largest diameter, that is, the layer or layers where the above-cited drawbacks normally concentrate in the cables in use up to now, will be those to be arranged according to the teachings of the present invention.

The construction details of the invention could, of course, vary according to needs, but it is to be understood that the invention includes within its scope any other alternative embodiment using the principals of the invention.

The embodiments of the invention in which an exclusive property or privilege is claimed are defined as follows:

1. An electric cable suitable for use at operating voltages of at least 1000 Kilovolts, said cable having a conductor and at least three insulating layers helically wound around the conductor, each layer being formed by tape impregnated with an insulating material and having surfaces without wrinkles, the tape of each layer being wound with a gap between the side edges of adjacent turns of the tape and with said gap between said side edges being offset with respect to the gap between the side edges of the turns of the tape of the next adjacent layer, whereby the said gap of one layer is covered by the tape of said next adjacent layer, and at least one of said layers comprising at least two tapes wound in side-by-side relation with their side edges in substantially parallel relation to provide multi-start helical tapes, said two tapes having their edges spaced apart in the direction of the length of the cable and the angle between the side edges of each tape and a plane extending axially of the cable being less than 75°.

2. An electric cable as set forth in claim 1 wherein said angle is about 70°.

3. An electric cable suitable for use at operating voltages of at least 1000 Kilovolts, said cable having a conductor and at least three insulating layers helically wound around the conductor, each layer being formed by tape impregnated with an insulating material and having surfaces without wrinkles, the tape of each layer being wound with a gap between the side edges of adjacent turns of the tape and with said gap between said side edges being offset with respect to the gap between the side edges of the turns of the tape of the next adjacent layer, whereby the said gap of one layer is covered by the tape of said next adjacent layer, and at least one of said layers comprising at least two tapes wound in side-by-side relation with their side edges in substantially parallel relation to provide multi-start helical tapes, said two tapes having their edges spaced apart in the direction of the length of the cable and at least said two tapes have a width less than 30 millimeters.

4. An electric cable suitable for use at operating voltages of at least 1000 Kilovolts, said cable having a conductor and at least three insulating layers helically wound around the conductor, each layer being formed by tape impregnated with an insulating material and having surfaces without wrinkles, the tape of each layer being wound with a gap between the side edges of adjacent turns of the tape and with said gap between said side edges being offset with respect to the gap between the side edges of the turns of the tape of the next adjacent layer, whereby the said gap of one layer is covered by the tape of said next adjacent layer, and at least one of said layers comprising at least two tapes wound in side-by-side relation with their side edges in substantially parallel relation to provide multi-start helical tapes, said two tapes having their edges spaced apart in the direction of the length of the cable and the angle between the side edges of each tape and a plane extending axially of the cable being less than 75° and the width of each tape being less than 30 millimeters.

* * * * *